United States Patent [19]

Seidl

[11] Patent Number: 4,558,676

[45] Date of Patent: Dec. 17, 1985

[54] TWO-CYLINDER, FOUR-STROKE-CYCLE, DOUBLE-PISTON ENGINE, ESPECIALLY AIR-FLOW-COOLED FOR MOTORCYCLES

[75] Inventor: Jiri Seidl, Munich, Fed. Rep. of Germany

[73] Assignee: Bayerische Motoren Werke AG, Fed. Rep. of Germany

[21] Appl. No.: 474,595

[22] PCT Filed: Jun. 24, 1982

[86] PCT No.: PCT/EP82/00133

§ 371 Date: Feb. 25, 1983

§ 102(e) Date: Feb. 25, 1983

[87] PCT Pub. No.: WO83/00188

PCT Pub. Date: Jan. 20, 1983

[30] Foreign Application Priority Data

Jun. 26, 1981 [DE] Fed. Rep. of Germany ..... 3125077

[51] Int. Cl.[4] ..... F02M 13/06

[52] U.S. Cl. ..... 123/432; 123/90.27

[58] Field of Search ..... 123/90.27, 90.31, 192 B, 123/56 AC, 432, 196 R, 195 H, 195 HC, 56 AA, 308

[56] References Cited

U.S. PATENT DOCUMENTS

| | | | |
|---|---|---|---|
| 374,800 | 6/1943 | Perreau | 123/308 |
| 2,140,085 | 12/1938 | Maina | 123/56 AC |
| 2,410,411 | 11/1946 | Gregory | 123/90.16 |
| 3,306,271 | 2/1967 | Turlay | 123/90.27 |
| 3,418,993 | 12/1968 | Scheiterlein et al. | 123/90.31 X |
| 4,156,409 | 5/1979 | Nakano | 123/192 B X |
| 4,317,438 | 3/1982 | Yagi et al. | 123/308 X |
| 4,320,671 | 3/1982 | Curasi | 123/192 B X |
| 4,395,980 | 8/1983 | Tominaga et al. | 123/90.27 |

FOREIGN PATENT DOCUMENTS

| | | | |
|---|---|---|---|
| 851081 | 9/1939 | France | 123/90.27 |
| 48003 | 3/1980 | Japan | 123/90.27 |

*Primary Examiner*—William R. Cline
*Assistant Examiner*—Peggy A. Neils
*Attorney, Agent, or Firm*—Craig & Burns

[57] ABSTRACT

An especially air-flow-cooled two-cylinder, four-stroke-cycle, double-piston engine (1) for the preferred use in motorcycles has for each cylinder (32) a camshaft (14) disposed horizontally on top in the cylinder heads (33) for the drive of valves (37 and 38) disposed in vertical V-positions. An intermediate shaft (4) is connected in the drive of the camshafts (14) which is driven by the crankshaft (3) with 1:2 down-gearing, with said intermediate shaft (4) being arranged parallel below the crank shaft (3), being driven at its front end—in driving direction—, carrying a pump wheel (12') of a lubricating-oil pump (12) and having two 1:1 drives (13) leading from its rear end in one tunnel each (36) of the cylinders (32) and cylinder heads (33) to the camshafts (14). The camshafts (14) are arranged in the V-space of the valves (37 and 38) and are in driving connection with the valves (37 and 38) by means of rocking levers (39). The intake connections (28') and the exhaust pipes (53) lead out of the cylinder heads (33) approximately vertically upward and downward.

3 Claims, 6 Drawing Figures

25
23
28
26
27
24
21
22
20
19
1
10
10
11
2'
5
11
10'
6
18
II
7
8
2'
10'
3'
3
3'
13
13
9
12
17'
12'
11'
4
11'
2
17
17'
15
16

TWO-CYLINDER, FOUR-STROKE-CYCLE, DOUBLE-PISTON ENGINE, ESPECIALLY AIR-FLOW-COOLED FOR MOTORCYCLES

The invention concerns a two-cylinder, four-stroke-cycle, double-piston engine of a construction for example, of the air-flow-cooled type for motorcycles, having a camshaft for each cylinder, with said camshaft being disposed on top and horizontally disposed, parallel to the crankshaft and 1:2-geared-down with respect to said crank shaft, with the camshaft being driven by an intermediate shaft geard down approximately 1:2 with respect to the speed of the crank shaft and arranged parallel to the crank shaft, by means of, in each case, one approximately 1:1 transmitted chain or belt drive, in which case, the chain or belt drives are disposed in driving direction behind the cylinders.

A known double-piston engine of this construction according to DE-OS No. 27 03 520 has a relatively fissured outer shape resulting especially from the arrangement of the valves and their gear. The reason is that the intermediate shaft for the drive of the two upper camshafts is arranged above the crankshaft, and the chain or belt drives extend, with separate coverings which are arranged at a distance from the cylinders and the cylinder heads, to control housings which, in each case, project from the cylinder head. The arrangement of, in each case, parallel inlet and outlet valves also contributes to the unsymmetrical and fissured construction of this double-piston engine. In addition, the housing components which project considerably beyond the basic contour of the cylinders and cylinder heads also result in a high cost of construction and correspondingly heavy weight.

It is the objective of the invention to avoid the above-mentioned disadvantages and to create a double-piston engine on the basis of the known construction which has a compact overall structure with low cost of construction and low weight, favorable conditions for good ground clearance when installed into motorcycles, an efficient and speed-fixed control with a V-valve arrangement, a largely smooth and appealing outer shape that is easy to clean as well as finally a good cooling-air flow at the cylinders and cylinder heads when it is air-flow-cooled.

In order to achieve this manifold objective, the invention provides an arrangement of the intermediate shaft below the crank shaft the drive of the intermediate shaft being at the front end of the crank shaft with a pump wheel of a lubricating-oil pump on the intermediate shaft. The chain or belt drives are in tunnels of the cylinders and cylinder heads, the valves with the drive by means of rocking levers in vertical V-position with the camshaft in the V-space, and the intake and exhaust-gas lines to and from the cylinder heads extending essentially vertically upward and downward. By means of these characteristics, the objective of the invention is achieved in a surprisingly favorable manner. Because of these characteristics, the valve drive including the oil-pump drive, requires very little space, without housing parts or coverings projecting beyond the basic contour of the engine components. The valve, camshaft and gas-changing duct arrangements also result in a very compact overall structure of the double-piston engine, with the intake and exhaust-gas systems resting closely against the outside contours on the upper side and the bottom side of the cylinders and cylinder heads.

The V-positions of the valves are, in each case, in their vertical plane, and are swivelled upward at an angle with respect to a horizontal-symmetrical arrangement so that the outlet valves are sloped downward by an angle of about 0° to 20°, and the inlet valves are sloped upward at an angle of about 30° to 50°—always in the direction of their shaft ends. The above arrangements are further improved so that the intake systems on the upper side of the cylinders and cylinder heads of both sides come still closer and, on the whole, require even less space, while the exhaust gas ducts on the bottom side of the cylinders and cylinder heads are provided with more space for leading the exhaust gas pipes toward the center of the vehicle which benefits the ground clearance in the case of motorcycles.

For each cylinder, two inlet valves are arranged parallel next to one another, in each case, on both sides of the vertical plane of the outlet valve in vertical planes of the same distance.

By the use of two inlet valves and one outlet valve as compared to one inlet valve and one outlet valve each makes it possible to obtain larger valve time cross sections in the case of a relatively small V-angle of the valves, which benefits the above-mentioned spatial advantages also and in addition increases or expands the performance and the speed range of the engine and makes possible a varying part-throttle control of both inlet ports.

The inlet valves have a relatively large free distance of their valve disks, and in the space created by this distance, a taphole for a spark plug is arranged in the vertical plane of the outlet valve, without chamfer, to the valve-seat rings of the inlet valves, in which case the valve disks of the inlet valves, in their closing position, are approximately tangent or somewhat overlap the horizontal axis of the contour of the pertaining cylinder, and are almost tangent to the contour of the mentioned cylinder. This results in a position of the spark plugs in the center of the combustion chamber or the upper side of the cylinder heads which is advantageous for the combustion sequence and the maintenance, without decreasing the above-mentioned advantages.

The bearing shafts of the rocking levers, in each case, have a pivot bearing journal for the rocking lever which is eccentric with respect to their stationary bearing journals in the cylinder head. In each case, at least one stationary bearing journal has a clamping device for the fixation of the rotating position of the bearing shaft. A key-cross-section is in one piece shaped to each bearing shaft at least on one front side. These features are advantageous for the speed fixation of the valve control because of the very small moved mass of the rocker arms as well as the overall width and the ground clearance for the installation of the engine into the motorcycle because of the low overall height of the valve control above the valve shaft ends.

With the above-described features, an engine may have cooling air ducts at the cylinder head for air-flow cooling, characterized in that the V-space of the valves is parallel to the camshaft. In each case, one cooling-air duct is disposed, having an inflow-opening that is open in driving direction and leading, at the opposite end in front of the tunnel of the chain or belt drive into a discharge compartment extending vertically upward and/or downward. These characteristics are advantageous in regard to the air-flow cooling of the cylinder head without negatively affecting the other advantages of the invention.

The crank chamber is divided in the vertical center plane and the crankshaft and the intermediate shaft are arranged in the center plane. One main bearing each is arranged on each side of lifting cranks of the crankshaft that are directly adjacent to one another and one balancing mass each is in one piece shaped onto the crankshaft directly outside the two main bearings and inside shaft sealings that are adjacent on both sides. These characteristics result in a very small distance between bearings of the crankshaft bearings and thus low bending moments from the crank forces and thus correspondingly small bendings of the crankshaft. On the other hand, the lever arm of the balancing masses is relatively large, by means of which these can be kept small and the overall weight of the engine is decreased correspondingly.

The balancing masses are developed as narrow disks and are arranged in correspondingly narrow annuli of the crank chamber between the main bearings and the shaft sealings. These characteristics therefore contain a corresponding weight- and space-saving development and arrangement of the balancing masses.

A double-piston engine configured as above described may have a surrounding fastening flange shaped onto the crank chamber at its top side, with the fastening flange having a number of fastening openings and/or tapholes for the fastening or the fastening screws of a hollow-plate frame piece. Within the top side enclosed by the fastening flange, a crank chamber ventilating opening leads out. Such a configuration results in a connection that is easy to seal, with a distributed introduction of forces, from a hollow-plate carrier of the frame into the crankchamber, in which case lines for the crank chamber ventilation are not necessary when the hollow-plate carrier of the frame is used as the intake space for the combustion air of the engine.

A double-piston engine as described above may have an essentially smooth-surfaced front wall lid of the crank chamber covering the secondary aggregates (generator) and/or the drive of the intermediate shaft, characterized in that an opening for the mounting of an oil filter installed in longitudinal horizontal position in the crank chamber is arranged in the wall of the crank housing that is covered by the front wall lid, with the opening having a detachable lid with one-piece connecting ducts to the oil ducts in the crank chamber. These features result in an arrangement of the closing lid for an oil filter avoiding a conventional fissured part of the outside wall with dirt traps. The accessibility for the oil filter exchange is maintained in an unchanged manner because during servicing work, the front wall lid must be taken off anyhow in order to examine other secondary aggregates.

Since the characteristics described above as the development of a cylinder head irrespective of a certain arrangement of the cylinders, have independent inventive significance, they may take the form of a cylinder head for four-stroke-cycle internal-combustion engines, having inlet and outlet valves suspended in V-position in the cylinder head, in which case, for each cylinder, two inlet valves are arranged parallel next to one another corresponding to a V-leg and an outlet valve is arranged corresponding to a second V-leg, the outlet valve being arranged in a parallel plane of equal distance containing the cylinder axis, between the two inlet valves, wherein the V-position of the inlet and outlet valves in regard to the cylinder axis is swivelled around at such an angle with respect to a symmetrical arrangement to the cylinder axis to the side of the inlet valves, that the outlet valve encloses an angle of about 0° to 20° and the plane determined by the inlet valves encloses an angle of about 30° to 50° with the cylinder axis, and the inlet valves have a relatively large free distance of their valve disks in which case in the area within this distance, as well as in the vertical plane determined by the outlet valve and the cylinder axis, a spark plug is arranged. The valve disks of the inlet valves in their closing position overlap that axis (horizontal axis) of the cylinder that is located in parallel to the plane determined by the inlet valves.

A double-piston engine and/or a cylinder head as described above, characterized in that the longitudinal axis of the spark plug with the cylinder axis encloses a larger angle—about 45° to 75°—than the plane determined by the inlet valves.

The invention results in a space requirement of the spark plug that avoids an excessive distance of the inlet valves and their valve springs. It may be used advantageously in the case of the double-piston engine as described above as well as in the case of the cylinder head of the character described above.

These and other objects, features, and advantages of the present invention will become more apparent from the following description when taken in connection with the accompanying drawings which show, for the purposes of illustration only, one embodiment in accordance with the present invention, and wherein.

Figure 1:
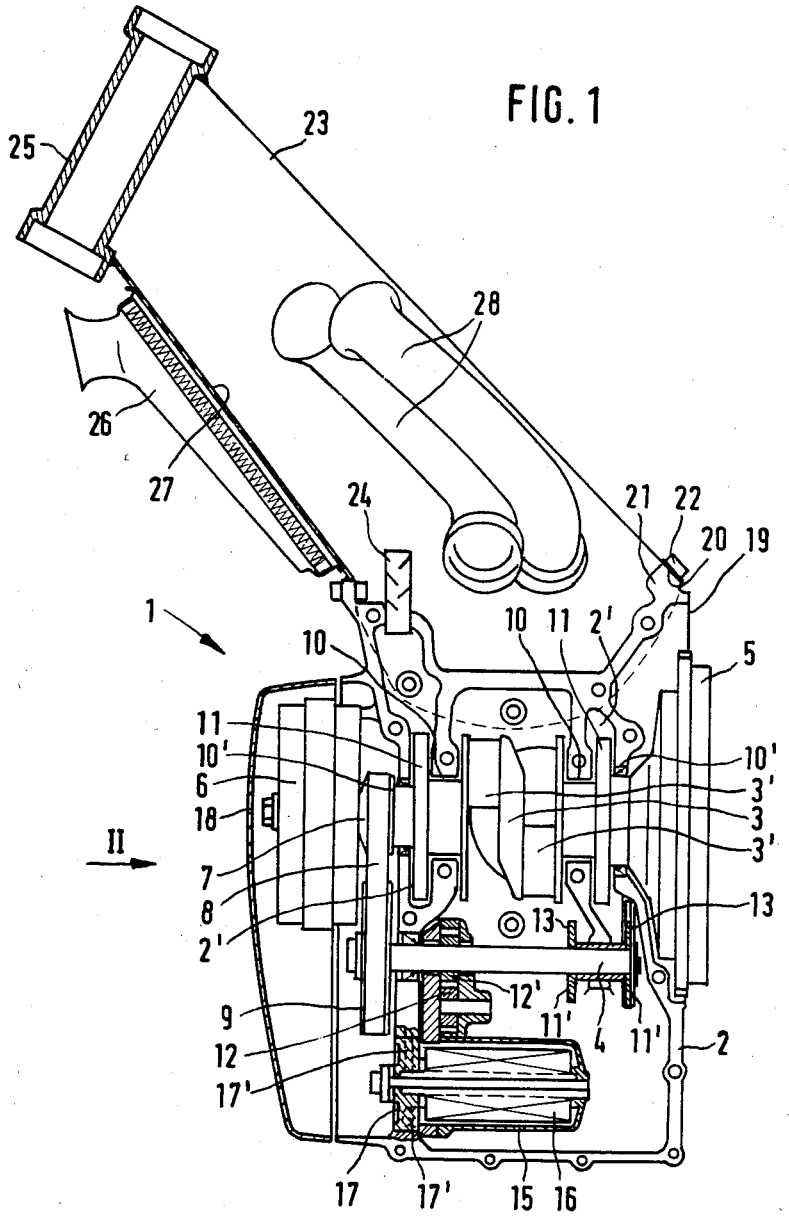
FIG. 1 shows a longitudinal section of an air-flow-cooled, two-cylinder, four-stroke-cycle, double-piston engine for motorcycles having hollow-plate frame pieces flanged to the upper side of the crank chamber, in a diagrammatic representation.

An air-flow-cooled two-cylinder, four-stroke-cycle, double-piston engine 1 has a crank chamber 2 that is divided in its vertical central longitudinal plane I—I. In FIG. 1, therefore, the longitudinal section in the area of the crank chamber is formed by leaving off its one half. In the central longitudinal plane I—I, a one-piece crankshaft 3 as well as an intermediate shaft 4 are disposed in sleeve bearings. At its driven end, the crankshaft 3 carries a flywheel 5, and at its opposite front end, a generator 6 as well as a toothed-belt wheel 7 for the 1:2 geared-down driving connection by means of a toothed belt 8 and another toothed-belt wheel 9 to the intermediate shaft 4. On both sides of its lifting cranks 3' and outside its main bearings 10, one each relatively narrow disk-shaped balancing mass 11 is shaped onto the the crankshaft 3, with said balancing masses 11 being arranged in correspondingly narrow annuli 2' of the crank chamber 2 between the main bearings 10 and the connecting shaft packings 10'. By means of the relatively large distance of the balancing masses 11, their balancing function is increased and their weight is reduced. By means of their arrangement, the distance of the main bearings 10 and thus the weight of the crank chamber 2 is reduced.

The intermediate shaft 4 drives a lubricating-oil pump 12, of which a pump wheel 12' is fastened on the intermediate shaft 4, as well as two chain drives 13 each to an upper camshaft 14. In the crank chamber 2, an oil filter 15 is also disposed, the filter unit 16 of which is accessible for maintenance work by means of an inside lid 17. The lid 17, the toothed-belt drive 7, 8 and 9, and the generator 6 are protected from environmental influences by a largely smooth-surfaced front-wall lid 18, with said lid, at the same time, facilitating the cleaning of the front side of the crank chamber 2.

On the rear side of the crank chamber 2, the flywheel 5 is framed by a mounting flange 19 for the connection of a gear housing that is not shown. Shaped to the upper side of the crank chamber 2 is a surrounding mounting flange 20 having a number of mounting holes 21 for mounting screws 22, to which a hollow-plate frame piece 23 is screwed. Within the upper side of the crank chamber 2 that is surrounded by the mounting flange 20, a crank chamber ventilation opening 24 leads out. The hollow-plate frame piece 23 connects the crank chamber 2, on a wide bending-resistant basis, with a control head 25 of a motorcycle. On its front side, the hollow-plate frame piece 23 has an intake air filter 26, through which filtered intake air through openings 27 flows into the inside of the hollow-plate frame piece 23. This is used as the intake space for the combustion air of the engine and contains length-adjusted intake pipes 28 which lead the combustion air to one carburetor 29 each. The carburetors 29 are partially located within indentations 30 of the hollow-plate frame part 23 having sealed openings 31 for the passage of the intake pipes 28, within said recesses 30.

Flanged to both sides of the crank chamber 2 is one cylinder 32 each, and flanged to said cylinder 32 is one cylinder head 33 each having one cylinder-head lid 34 each. The cylinder 32, the cylinder head 33 and the cylinder-head lid 34 have numerous cooling ribs 35 for air-flow cooling. They also each have a tunnel 36 for receiving the chain drives 13, which extend from the intermediate shaft 4 in the crank chamber 2 to the camshafts 14 in the cylinder heads 33, in driving direction, on the rear side of the cylinders 32 and the cylinder heads 33. The chain drives 13 have a 1:1 transmission, so that on the intermediate shaft 4 as well as on the camshafts 14, small chain wheels 13' may be used. These require little space, even in the cylinder heads 33 and the cylinder-head lids 34. The valve control for in each case two inlet valves 37 and one outlet valve 38 by means of three rocker arms 39 as transmission elements from the camshaft 14 to the valves 37 and 38, on the other hand, has a somewhat larger lateral range so that the cylinder-head lids 34 have an outside shape that is rounded off to all sides and has no projections. This improves their outside appearance and facilitates their cleaning and results in a smaller overall width of the double-piston engine and also of the motorcycle (FIGS. 2 and 3) equipped with said engine.

The valves 37 and 38 are arranged in vertical V-position. The two inlet valves 37 are, in each case, arranged in parallel to one another corresponding to a V-leg determined by the plane of the two inlet valves 37 and having an upward slope of about 37°—seen in the direction toward the shaft end of the inlet valves 37. The V-leg determined by the outlet valves 38, on the other hand, has a corresponding downward slope of about 15°. The camshafts are each disposed in a position that cuts the angle in half within the approximate 52°-V-position of the valves 37 and 38.

Figure 2:
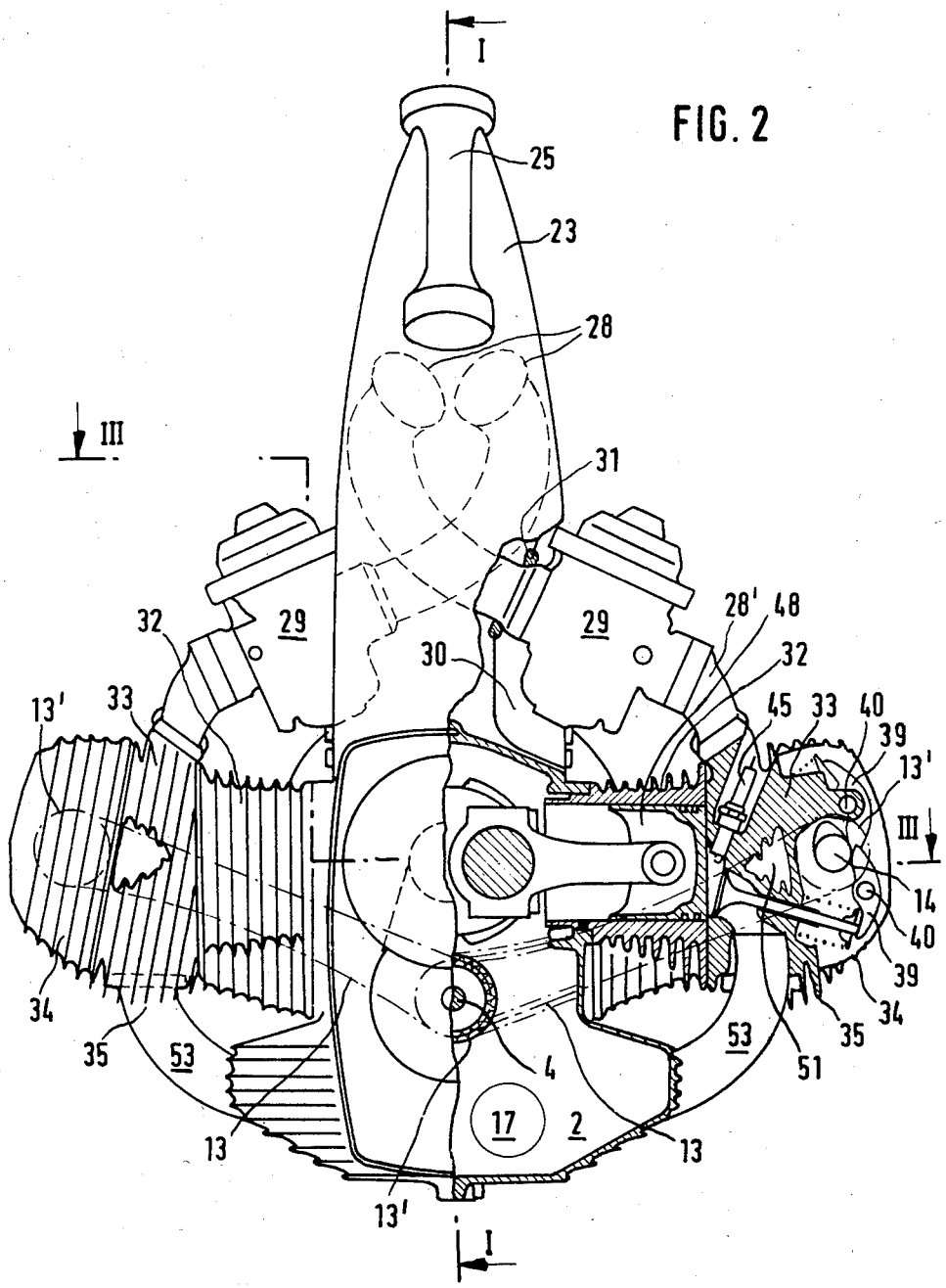
FIG. 2 shows a partially cut front view according to the Arrow II in FIG. 1.
Figure 3:
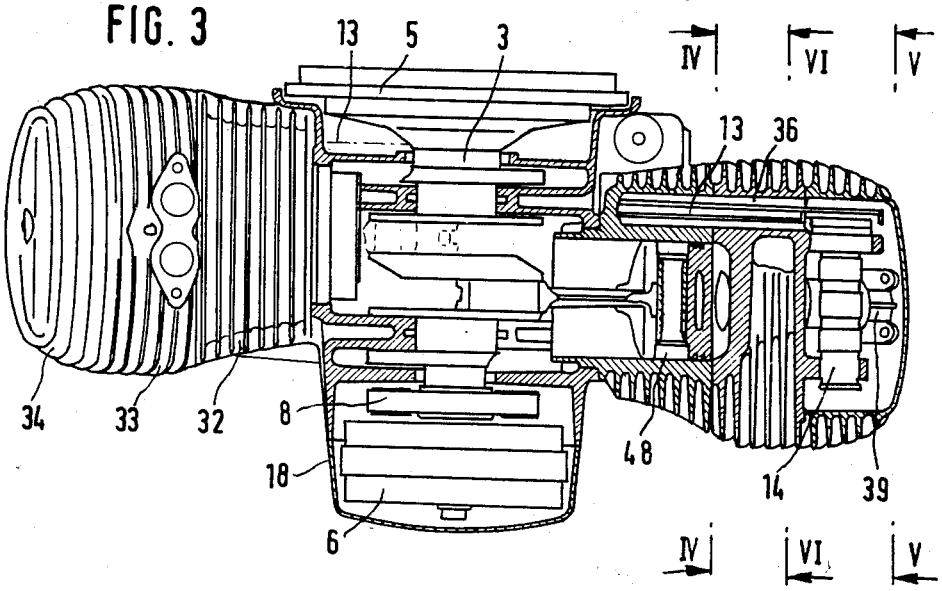
FIG. 3 is a partially cut plan view according to the Line III—III in FIG. 2.
Figure 5:
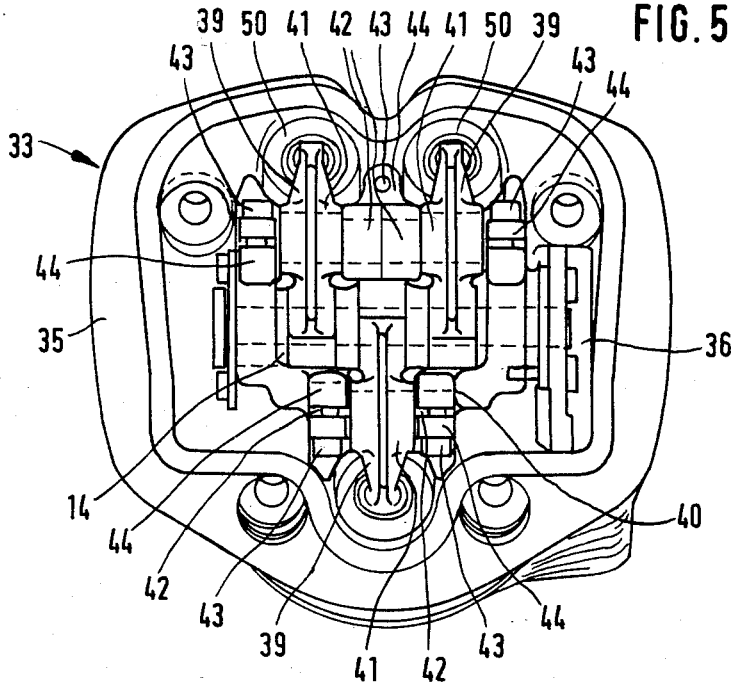
FIG. 5 is a top view of the open valve control according to Line V—V in FIG. 3.
Figure 6:
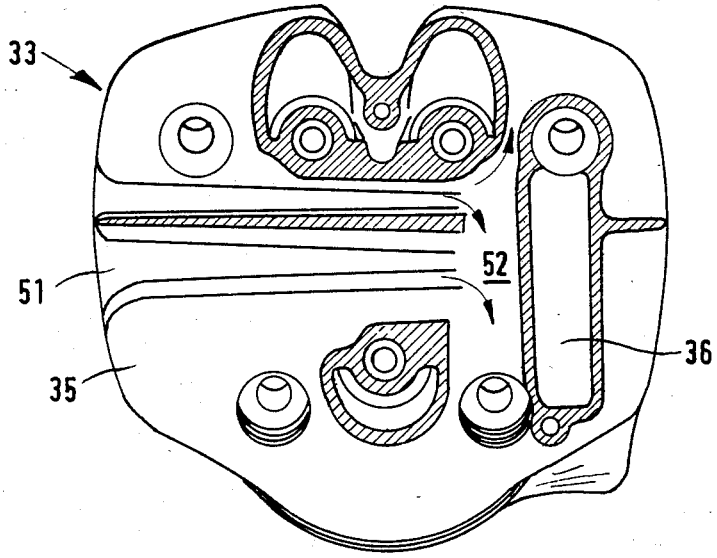
FIG. 6 shows a longitudinal section through the cooling-air duct in the cylinder head according to the Line VI—VI in FIG. 3.

The rocker arms 39 for the drive of in each case one valve 37 and 38 are rotatably disposed on bearing shafts 40. Their pivot-bearing journals 41 are disposed eccentrically with respect to their stationary-bearing journals 42 for the valve-clearance adjustment (FIGS. 2 and 5). Their stationary-bearing journals 42 can be fastened in bearing blocks 44 of the cylinder head 33 so that they are firm with respect to rotation, with said bearing blocks 44 being able to be locked in place by means of screws 43. For the valve-clearance adjusting process, a key profile—not shown in the drawing—is shaped onto the bearing shafts 40 at, in each case, one accessible front end. In this case, an inside profile is preferred because it requires no space and reduces weight as a recess in the material. The valve control as a whole therefore requires little space and cost of construction and contains no additional moved components for the valve-clearance adjustment.

Figure 4:
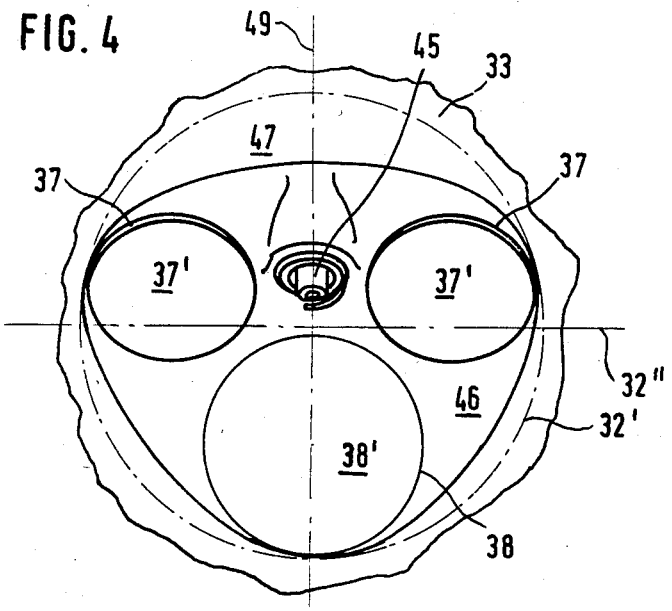
FIG. 4 is an inside view of the combustion chamber in the cylinder head with the valve and spark-plug arrangement according to the Line IV—IV in FIG. 3.

An advantageous development of the combustion chamber 46 (FIGS. 2 and 4) is obtained on the basis of the above-described V-position of the valves 37 and 38 in connection with the arrangement of, in each case, the two inlet valves 37 and their valve disks 37' at a relatively large free distance, and the arrangement of a spark plug 45 in the space created by this distance. The valve disks 37' and 38' of the inlet 37 and outlet valves 38 rest almost tangently close on the pertaining contour 32' of the pertaining cylinder 32 as well as at a relatively narrow distance between the valve disk 37' and in each case one valve disk 38'. In this case, the valve plates 38' overlap the horizontal axis 32'' of the contour 32'. The spark gap of the spark plug 45 is located centrally between the valves 37 and 38 in the combustion chamber 46. In the upper area of the combustion chamber 46, a large press area 47 can be developed which interacting with a flat bottom section of a piston 48 permits a press gap with a favorable influence on the combustion process. The spark plug 45 is arranged in a steeper slope than the inlet valves 37 in the vertical plane 49 together with the outlet valve 38. The space requirement for the installation of the spark plug is therefore not set off (sic) between the space requirement of the valve springs 50 of the inlet valves 37. In addition, the spark plugs and their electrical connections therefore have an especially favorable accessibility for servicing purposes.

For the air-flow cooling of the cylinder heads 33, a cooling-air duct 51 that is open and horizontal in driving direction is provided parallel to the camshaft 14 in the V-space of the valves 37 and 38. Said cooling-air duct 51, at its end that is opposite to the driving direction, leads into a vertical discharge duct 52 which is disposed in front of the tunnel 36 of the chain drive 13 and is open toward the top and the bottom. This ensures a highly effective cooling of the cylinder heads 33 without additional requirements in regard to space and cost.

A favorable space-saving arrangement results from the above-described arrangement of valves also for the exhaust connections 28' with the carburetors 29 and for the exhaust gas pipes 53. While the intake system at the top side of the engine, in a space-saving manner, rests closely against the hollow-plate frame part 23 and therefore has a narrow width, sufficient space is available for the exhaust-gas lines 53 with relatively large radii with little resistance in regard to flow, without impairing the ground clearance and sloping-position clearance for the motorcycle driving operation.

The overall construction of the two-cylinder, four-stroke-cycle, double-piston engine, according to the invention, results, mainly for the use in motorcycles, in a summation of mutually complementing advantages in regard to high performance, efficient cooling, good driving features, low weight and cost of construction, small space requirements and an appealing outer shape. However, a large number of these advantages also exist in the case of a stationary and/or enclosed use with blast air or liquid cooling.

While I have shown and described only one embodiment in accordance with the present invention, it is understood that the same is not limited thereto but is susceptible to numerous changes and modifications as known to one having ordinary skill in the art, and I therefore do not wish to be limited to the details shown and described herein, but intend to cover all such modifications as are encompassed by the scope of the appended claims.

I claim:

1. A cylinder head for four-stroke-cycle internal-combustion engines, having inlet and outlet valves suspended in V-position in the cylinder head, in which case, for each cylinder, two inlet valves are arranged parallel to one another, their shafts corresponding to one V-leg, and one outlet valve is arranged approximately therebetween the shaft of which corresponds to a second V-leg and substantially equidistant from the inlet valves and in a plane containing the cylinder axis, characterized in that the V-position of the inlet and outlet valve shafts is disposed such that the outlet valve shaft enclose an angle of about 0° to 20° with the cylinder axis, the plane determined by the inlet valve shafts enclosing an angle of about 30° to 50° with the cylinder axis, an area lying substantially between the inlet valves which encompasses the plane determined by the outlet valve shaft and the cylinder axis, a spark plug arranged within said area, and the valve disks of the inlet valves in their closing position overlap a plane of the cylinder cross-section containing the axis of the cylinder and that is located substantially equidistant from the centers of the valve disks of the inlet valves.

2. A cylinder head according to claim 1, wherein the longitudinal axis of the sparkplug with the cylinder axis encloses an angle of substantially 45° to 75°, larger than the angle determined by the valves.

3. A cylinder head in accordance with claim 1, wherein the outer periphery of the inlet and outlet valves lie entirely within the periphery of the cylinder.

* * * * *